US005140934A

United States Patent [19]

Pennelle

[11] Patent Number: 5,140,934

[45] Date of Patent: Aug. 25, 1992

[54] BOOKMARK

[76] Inventor: Joseph F. Pennelle, 3434 N. Nagle Ave., Chicago, Ill. 60634

[21] Appl. No.: 571,321

[22] Filed: Aug. 22, 1990

[51] Int. Cl.[5] ..... B42D 9/00

[52] U.S. Cl. ..... 116/234

[58] Field of Search ..... 116/234–240; 40/302; 281/42, 38, 39

[56] References Cited

U.S. PATENT DOCUMENTS

| | | | |
|---|---|---|---|
| 1,559,129 | 10/1925 | Pimm | 281/38 |
| 2,034,413 | 3/1936 | Ottinger | 116/239 |
| 2,344,613 | 3/1944 | Hellstern | 116/237 |
| 4,448,310 | 5/1984 | Hodgson | 206/526 |

FOREIGN PATENT DOCUMENTS

| | | | |
|---|---|---|---|
| 851491 | 10/1952 | Fed. Rep. of Germany | 281/42 |
| 2526194 | 11/1983 | France | 40/638 |
| 585130 | 1/1947 | United Kingdom | 281/42 |
| 764283 | 12/1956 | United Kingdom | 116/239 |

*Primary Examiner*—William A. Cuchlinski, Jr.
*Assistant Examiner*—W. Morris Worth
*Attorney, Agent, or Firm*—Laff, Whitesel, Conte & Saret

[57] ABSTRACT

A printers convenience item may be added to a volume such as a book, magazine, folder containing a stack of papers or the like. The convenience item provides a bookmark which projects away from a side page in the volume so that it may fold over edges of the pages to act as a bookmark.

11 Claims, 2 Drawing Sheets

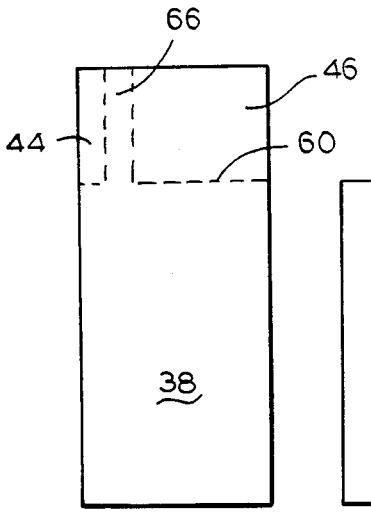
FIG.5A
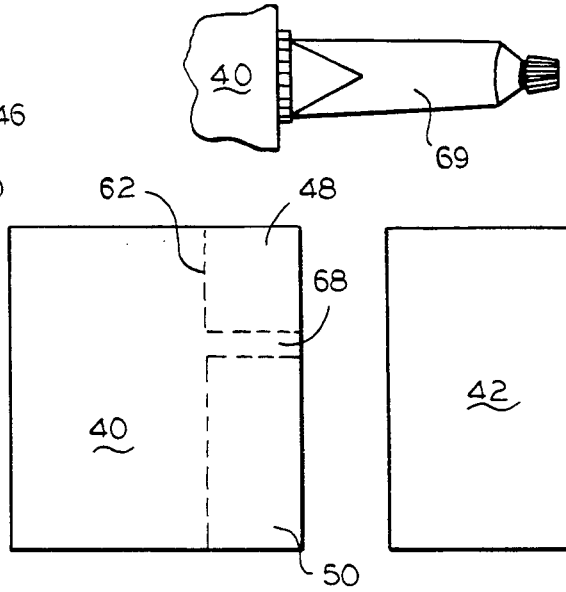
FIG.5B
FIG.5C
FIG.5D
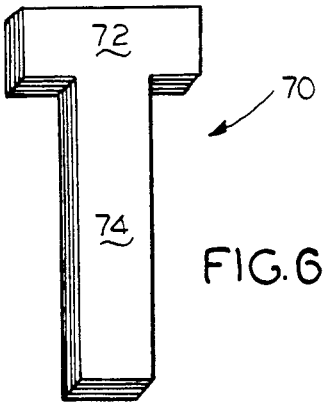
FIG.6
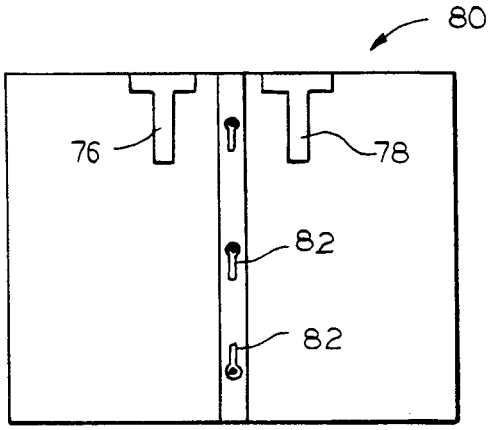
FIG.7A
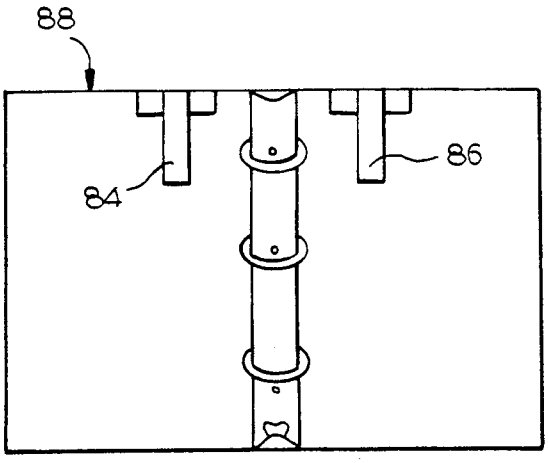
FIG.7B
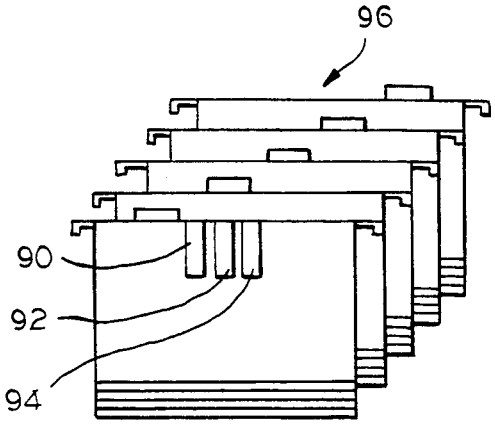
FIG.7C

BOOKMARK

This invention relates to publisher's sales aids, and more particularly to convenience items which not only increase the sales appeal of published items, but also provide such a consumer convenience that the consumer may wish to buy and add the items to preexisting products which they own.

In the case of a magazine and similar publications, a printer prepares publications which are sold to the reading public at a lower cost because much of the printing cost is subsidized by the advertisers whose advertisements appear therein. If a sales incentive can be added to the advertisement in order to induce readers to look at those pages, the price of the advertising page could be increased to decrease the price of the publication to the consumer. The price reduction would further increase the circulation of the publication and probably recover the added cost to the advertiser.

In the case of books, the advantage of such convenience items may not be so directly tied into an immediate return on investment. However, for many of the popular titles, textbooks, and the like, there may be an added incentive to select one publisher's books over the books of another publisher if a convenience item is added to the book.

Once people become accustomed to the convenience item, they may wish to buy it and add it to publications which they own and which were not originally produced with the convenience item in them.

For convenience of expression, the term "volume" is used and is to be construed herein as including any stack of pages that might be used with a bookmark, such volumes including books, magazines, bound or unbound papers in folders, and all other similar materials.

Accordingly, an object of the invention is to provide new and improved means for enhancing the convenience of printed items. Here, an object is to so enhance these items at almost no added cost. In particular, an object is to provide bookmarks which cannot be lost or misplaced and yet, which are always quickly and easily available for almost instant use with any bound volume.

Another object of the invention is to achieve the foregoing objects in a publication or volume which did not originally contain it. Here an object is to provide a convenience item which may be used in almost any of many places which may occur to people who have a need for the convenience provided by the item.

In keeping with an aspect of the invention, these and other objects are achieved by a finger member which may be built into a volume or other publication as an integral part thereof. The finger may function as a bookmark that cannot be lost. It is thought that after this convenience feature has caught the attention and acceptance of the public, they will want to add it to many different things such as preexisting books, magazines, file folders, and the like. Therefore, a pad of these finger members may have individual sheets with a self-adhesive on one side and a release surface on the opposite side so that the adhesive sheets may be peeled off and used, as required.

Preferred embodiments of the invention are shown in the attached drawings wherein:

FIGS. 5A–5C show an embodiment wherein the inventive item is used in connection with tear out advertiser items;

FIG. 5D shows a die cut bookmark, here in the form of a tube of toothpaste;

FIG. 6 is a perspective view of the inventive item which shows a pad of peel off bookmarks which may be used by the consumer at any convenient location; and FIG. 7A–7C show a few of the uses of the inventive items in connection with other structures.

Figure 1A:
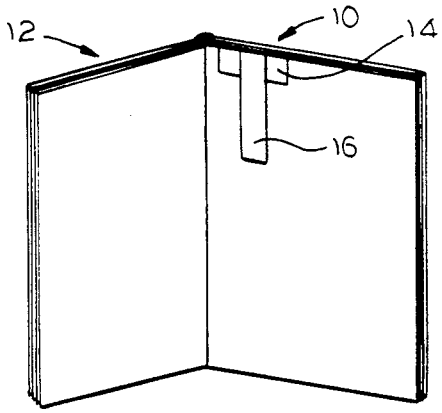
FIG. 1A shows, by way of example, the emplacement of the inventive item on the inside of the back cover of a volume, such as a book.

FIG. 1A shows a volume with the inventive item 10 emplaced, by way of example, on the inside surfaces of the back cover of a volume in the form of book 12. Here, a T-shaped sheet member 10 has the crossmember 14 of the T affixed or adhered near the top of the inside cover (either front or back cover) with the stem 16 of the T folded over and completely free, flat against the inside cover.

Figure 1B:
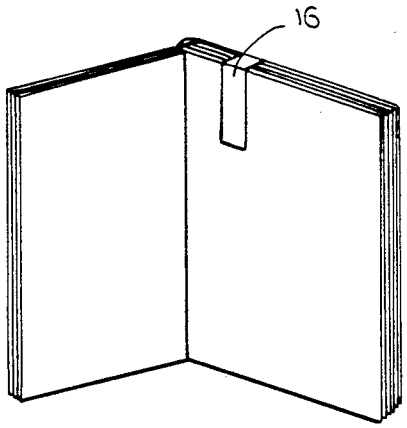
FIG. 1B shows a use of the inventive item of FIG. 1A.

FIG. 1B shows the stem 16 of the T in use as a bookmark. The bookmark cannot be lost and is easily returned to the inside of the back cover so that is out of the way when the volume is in use, while remaining accessible for the next use.

Figure 2A:
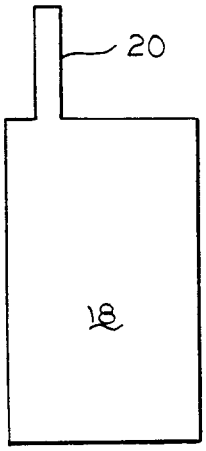
FIG. 2A shows the inventive item on a magazine page or cover.

FIG. 2A shows an embodiment for use, preferably in a bound volume, such as a magazine or the like. Here (FIG. 2C), the page 18 is initially cut with a finger 20 projecting therefrom. Then finger 20 is folded down approximately 3/16" from the top edge (as at 21) and over the page 18 (FIG. 2B) before it is bound into a volume such as a magazine, book, or the like. (The term "a dimension" is used to include trimming in both a height and a width dimension). Therefore, when the pages of the volume are trimmed after it is bound, the finger is not cut off. That is, when the top edges of the pages are trimmed to give the bound volume a final and finished appearance, the top of the finger 20 of page 18 is far enough inside the book to escape the paper cutting knife and so the finger 20 remains attached for use as a bookmark. This is the preferred method of making finger 20 since an undersized page 18 might shift during binding. Thus, all pages of the volume should have the same outside dimensions before they are bound and trimmed.

Figure 2B:
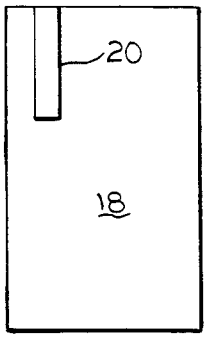
FIG. 2B shows a use of the inventive item of FIG. 2A.
Figure 3A:
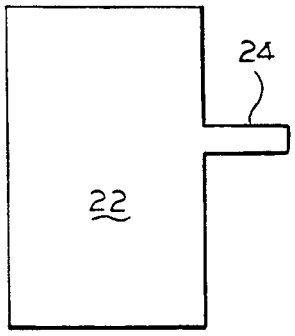
FIGS. 3A and 3B show another optional location of the inventive item on a side of a page or cover.
Figure 3B:
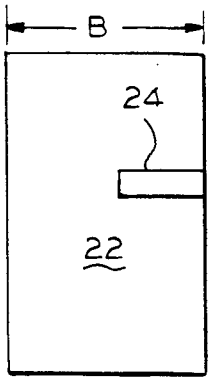
Figure 2C:
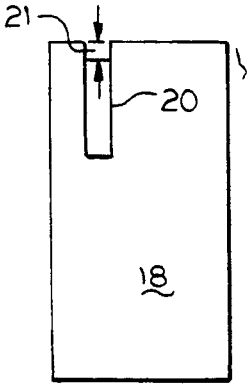
FIG. 2C shows how to construct the embodiment of FIG. 2A.

FIGS. 3A, 3B shows a substantially similar arrangement except that the projecting finger 24 is on the side instead of on the top of the page, as in FIGS. 2A, 2B. Here the width W of the page is slightly smaller than standard so that the finger 24 is not cut off when the side edges of the pages are trimmed.

Figure 4A:
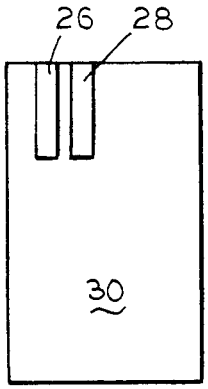
FIGS. 4A and 4B show multiple inventive items at different locations on the page or cover.
Figure 4B:
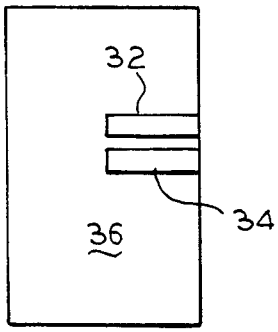

In FIGS. 4A, 4B, the principles of FIGS. 2, 3 are used to make multiple fingers 26, 28 at the top of page 30 or fingers 32, 34 at the side of page 36. Of course, any suitable number of fingers may be provided at any side or sides of the page. This way, in use, the bookmark may be placed at several different pages of the volume.

FIGS. 5A-5C show a different principle wherein a page 38-42 has an item or items 44-58 which are to be torn out by the person reading the publication. For example, item 44 might carry a lucky number to be retained for a sweepstakes drawing. Items 46, 48 may be return postcards. Item 50 might carry information such as a calendar, recipe, listing of interesting information, international telephone access codes, currency converter, metric measurements, or the like. Item 52-58 may be a collection of all of the above, or another and similar tear out item.

In any event, the tear out devices 44-58 fold along the lines 60, 62, 64 to a position completely within the publication (i.e., lines 60-64 correspond to approximately the edges of the volume). After the items 44-50 are torn off the page, a finger 66, 68 remains to act as a bookmark. In the example of FIG. 5C, it would be unlikely that all of the items 52-58 would necessarily be torn off the page. Therefore, those items which remain will function as one or more bookmarks.

In the case of FIG. 5D, the bookmark could have any suitable die cut shape or appearance, such as a tube of toothpaste 69, or a roll of candy, a candy bar, a beverage container, or the like. Hence, this is an inducement for an advertiser to pay a little more for the advertisement on the page with the finger.

In each of the examples of FIGS. 2-5, the pages 18, 22, 30, 36, 38, 40, 42 may carry advertisement that is seen when the reader turns to use the finger as a bookmark.

The invention is particularly attractive when used on a page made of one of the modern plastic paper substitutes. A particularly attractive synthetic printing sheet is sold under the trademark "TESLIN" by PPG Industries, Inc., Teslin Products, 36th Floor, One PPG Place, Pittsburgh, Pennsylvania 15272.

The manufacturer describes "TESLIN" as a single layer, highly filled, microporous, plastic film. The base material is in the polyolefin family, although the major component of the product is air—about 65 percent. "TESLIN" can be adapted to a wide range of printing and fabricating techniques. It accepts a broad variety of inks and can be printed with offset, inkjet, screen, laser, and thermal transfer processes. "TESLIN" is an uncoated film that inks, adhesives, coatings and laminating films can form bonds directly with the substrate.

| | PROPERTIES OF TESLIN | | | | | |
|---|---|---|---|---|---|---|
| | SP-700 | SP-800 | SP-1000 | SP-1400 | SP-1800 | ASTM Method |
| Gauge (mils) | 7.4 | 8 | 10 | 14 | 18 | D-374 |
| Tolerance (+/−mils) | 0.5 | 0.5 | 0.5 | 0.7 | 1.0 | |
| Yield (si/lb) +/−5% | 7700 | 6700 | 5200 | 3600 | 2550 | D-3776 |
| Basis Weight +/−5% | | | | | | |
| (oz/sq yd) | 2.69 | 3.09 | 3.99 | 5.76 | 8.13 | |
| (lbs/500 shts 25 × 38) | 62 | 71 | 91 | 132 | 186 | |
| (lbs/M sq yd) | 168 | 193 | 249 | 360 | 508 | |
| (sq yd/lb) | 5.94 | 5.17 | 4.01 | 2.78 | 1.97 | |
| Mill Roll Length (feet) | 6000 | 5250 | 4200 | 3300 | 2400 | |
| Roll Diameter (inches OD) | 28 | 28 | 28 | 28 | 28 | |
| Web Width (inches) | 25.75 | 25.75 | 25.75 | 25.75 | 25.50 | |
| Roll Weight (lbs) | 240 | 242 | 250 | 283 | 288 | |
| Tensile Properties | | | | | | |
| Tensile Strength (lb/in) | | | | | | |
| MD | 11.6 | 12.5 | 15.5 | 18.7 | 22.2 | D-882 |
| CD | 4.9 | 5.2 | 6.3 | 8.9 | 10.8 | |
| Elongation (%) | | | | | | |
| MD | 249 | 322 | 450 | 570 | 684 | D-882 |
| CD | 480 | 510 | 628 | 790 | 934 | |
| Elmendorf Tear | | | | | | |
| MD - notched (grams) | 53 | 67 | 109 | 201 | 293 | D-1992 |
| CD - notched (grams) | tore to md | tore to md | tore to md | tore to md | stretched | |
| Brittleness Temperature | <−70 deg C. | <−70 deg C. | <−70 deg C. | <−70 deg C. | <−70 deg C. | D-746 |
| Optical Properties | | | | | | |
| Brightness (%) | 96.7 | 97.2 | 97.2 | 97.3 | 97.5 | ISO-2470 |
| Whiteness (%) | 93.7 | 94.0 | 94.2 | 94.9 | 95.6 | |
| Opacity (%) | 94.1 | 95.4 | 96.3 | 97.6 | 99.0 | ISO-2471 |
| Transmission (%) | 11.4 | 9.9 | 8.8 | 6.1 | 3.7 | D-1003 |

This "Teslin" material has the qualities of paper and may be bound in the volume as all pages are bound, and yet is tough enough to survive very rough usage as a bookmark. Therefore, either it or a competitive material is preferred, although paper, or other suitable material may be used to make the bookmark finger.

In another embodiment, a T-shaped pad 70 (FIG. 6) may be provided. On the cross part 72 of the "T", each sheet in the pad has a self-adhesive on one side and a release material on the opposite side of the sheet. Therefore, each sheet may be peeled off the pad 70 one at a time and stuck at any convenient location on a volume such as a book, a magazine, or other device.

By way of example, FIG. 7A shows two of the peel off sheets 76, 78 stuck on the top edge of a binder folder 80 with fasteners 82. In FIG. 7B, the peel off sheets 84, 86 are stuck on the top edge of an inside surface of a looseleaf cover which may contain a volume of papers. In FIG. 7C, the peel off sheets 90-94 are stuck on an edge of a hanging file folder 96 which may eventually contain a volume of papers. One can easily think of many other uses for the invention.

Those who are skilled in the art will readily perceive how to modify the invention. Therefore, the appended claims are to be construed to cover all equivalent structures which fall within the true scope and spirit of the invention.

What is claimed is:

1. A publisher's convenience item comprising a page in a volume of pages, at least one finger member which is an integral part of said page in a volume of pages, said finger member extending from an edge of said page and being hinged by folding into said volume, said hinge being formed at a location at said edge of said page so that said finger member may fold over said edge of said pages to function as a bookmark, said page having length and width dimensions, one of said dimensions of said page extending in a direction of said finger member initially being slightly larger than a final dimension of said page, said finger member being folded down to make the page shorter at a location of said fold down so that said finger is not cut off when said page is trimmed.

2. The item of claim 1 wherein said edge is a top edge of said page.

3. The item of claim 1 wherein said edge is a side edge of said page.

4. The item of claim 1 wherein there is a plurality of said finger members projecting from said page at said edge thereof.

5. The item of claim 1 wherein said page is made of a plastic paper substitute.

6. The item of claim 1 wherein said finger member is formed by at least one tear out item projecting from said edge of said page.

7. The item of claim 6 wherein said finger member is an integral part of said page which remains after said tear out item is removed from said page.

8. The item of claim 7 wherein said edge is a top edge of said page.

9. The item of claim 7 wherein said edge is a side edge of said page.

10. The item of claim 6 wherein said page is made of a paper substitute.

11. The item of claim 1 wherein said finger member comprises an original part of a published item for providing an integral and non-removable finger member which functions as said bookmark.

* * * * *